US005655371A

United States Patent [19]

Chuang et al.

[11] Patent Number: 5,655,371

[45] Date of Patent: Aug. 12, 1997

[54] MOTION CONTROL MECHANISM OF OIL PRESSURE CYLINDER WITHOUT OIL PRESSURE PUMP

[76] Inventors: shiu-cheng Chuang, No. 72, Lane 305, Sec. 3, Jongshan Road; tsung-ning Lee, No. 13, Lane 202, Sec. 3, Jongshan Road, both of Tarntzyy Shiang Taichung County; tsang-haur Chang, No. 4, Alley 12, Lane 37, Sec. 1, Donshan Road, Taichung city, all of Taiwan

[21] Appl. No.: 512,322

[22] Filed: Aug. 8, 1995

[51] Int. Cl.[6] ..... F15B 7/00

[52] U.S. Cl. ..... 60/545; 60/571

[58] Field of Search ..... 92/31, 187, 165 PR; 60/545, 571, 593; 74/89.15

[56] References Cited

U.S. PATENT DOCUMENTS

| | | | |
|---|---|---|---|
| 2,433,990 | 1/1948 | Hardy | 60/571 X |
| 2,471,619 | 5/1949 | Hardy | 60/571 X |
| 2,936,737 | 5/1960 | Miller | 92/31 X |
| 3,191,264 | 6/1965 | Underwood et al. | 92/187 X |
| 3,640,140 | 2/1972 | Gulick et al. | 74/89.15 |
| 3,979,999 | 9/1976 | Emenaker | 92/165 PR X |
| 4,070,122 | 1/1978 | Wisner | 92/187 X |
| 4,531,269 | 7/1985 | LaBouff | 92/187 X |
| 4,633,726 | 1/1987 | Chang | 60/571 X |
| 4,838,102 | 6/1989 | Bode et al. | 92/31 X |
| 5,046,402 | 9/1991 | Lagace | 92/31 X |
| 5,481,877 | 1/1996 | Bakke et al. | 60/571 |

*Primary Examiner*—Edward K. Look
*Attorney, Agent, or Firm*—Pro-Techtor International

[57] ABSTRACT

A motion control mechanism of the oil pressure cylinder comprises an oil storing cylinder, a driving rod and a reversible motor. The oil storing cylinder is in communication with the oil pressure cylinder having a piston rod and is provided therein with a piston which is provided at one end thereof with a coupling portion. The driving rod is provided at one end thereof with a connection head engageable with the coupling portion of the piston and is further provided therein axially with a threaded hole engageable with a threaded rod which is fastened at one end thereof with an output shaft of the reversible motor. The piston is actuated by the driving rod to move back and forth within the oil storing cylinder so as to control the motion of the piston rod of the oil pressure cylinder.

1 Claim, 4 Drawing Sheets

MOTION CONTROL MECHANISM OF OIL PRESSURE CYLINDER WITHOUT OIL PRESSURE PUMP

FIELD OF THE INVENTION

The present invention relates generally to an oil pressure cylinder, and more particularly to a motion control mechanism of the oil pressure cylinder without oil pressure pump.

BACKGROUND OF THE INVENTION

The motion of the piston rod of the conventional oil pressure cylinder is regulated by the oil pressure power supply system which is composed of the oil pressure pump and the oil container and is therefore relatively large in size. It is therefore readily conceivable that the conventional oil pressure cylinder is not cost-effective, and that the conventional oil pressure cylinder takes up too much of the space of a machine tool to which the conventional oil pressure cylinder is attached, and further that the conventional oil pressure cylinder can not be fitted into a compact machine tool.

SUMMARY OF THE INVENTION

It is therefore the primary objective of the present invention to provide an oil pressure cylinder which can be made economically.

It is another objective of the present invention to provide an oil pressure cylinder which is relatively small in size and does not take up too much of the space of a machine tool to which the oil pressure cylinder is attacked.

The foregoing objectives of the present invention are attained by a motion control mechanism of the oil pressure cylinder without an oil pressure pump. The motion control mechanism comprises mainly a closed oil storing cylinder, a driving rod, and a reversible motor. The oil storing cylinder is provided therein with a piston which is provided at one end thereof with a coupling portion. The driving rod is provided at one end thereof with a connection head engageable with the coupling portion of the piston and is further provided therein axiallly with a threaded hole engageable with a threaded rod. The threaded rod is provided at the outer end thereof with a retaining slot engageable with the decelerating output shaft of the reversible motor. The piston is actuated by the driving rod to move back and forth within the oil storing cylinder so as to regulate the motion of the piston rod of the oil pressure cylinder.

The driving rod is provided at one end thereof with a rotation restricting plate having a plurality of through holes corresponding in location and number with the fastening holes of a support seat. The driving rod is supported on four supporting rods which are fastened respectively at one end thereof with the oil storing cylinder via the through holes of the rotation restricting plate and the fastening holes of the support seat. The supporting rods serve to restrict the rotation of the driving rod. As the threaded rod is rotated reversibly by the reversible motor, the driving rod is effectively actuated to move back and forth.

The driving rod is further provided at one end thereof with a toothed rod engageable with a gear which is fastened with the output shaft of the reversible motor for regulating the back-and-forth motion of the driving rod.

DETAILED DESCRIPTION OF THE EMBODIMENTS

Figure 1:
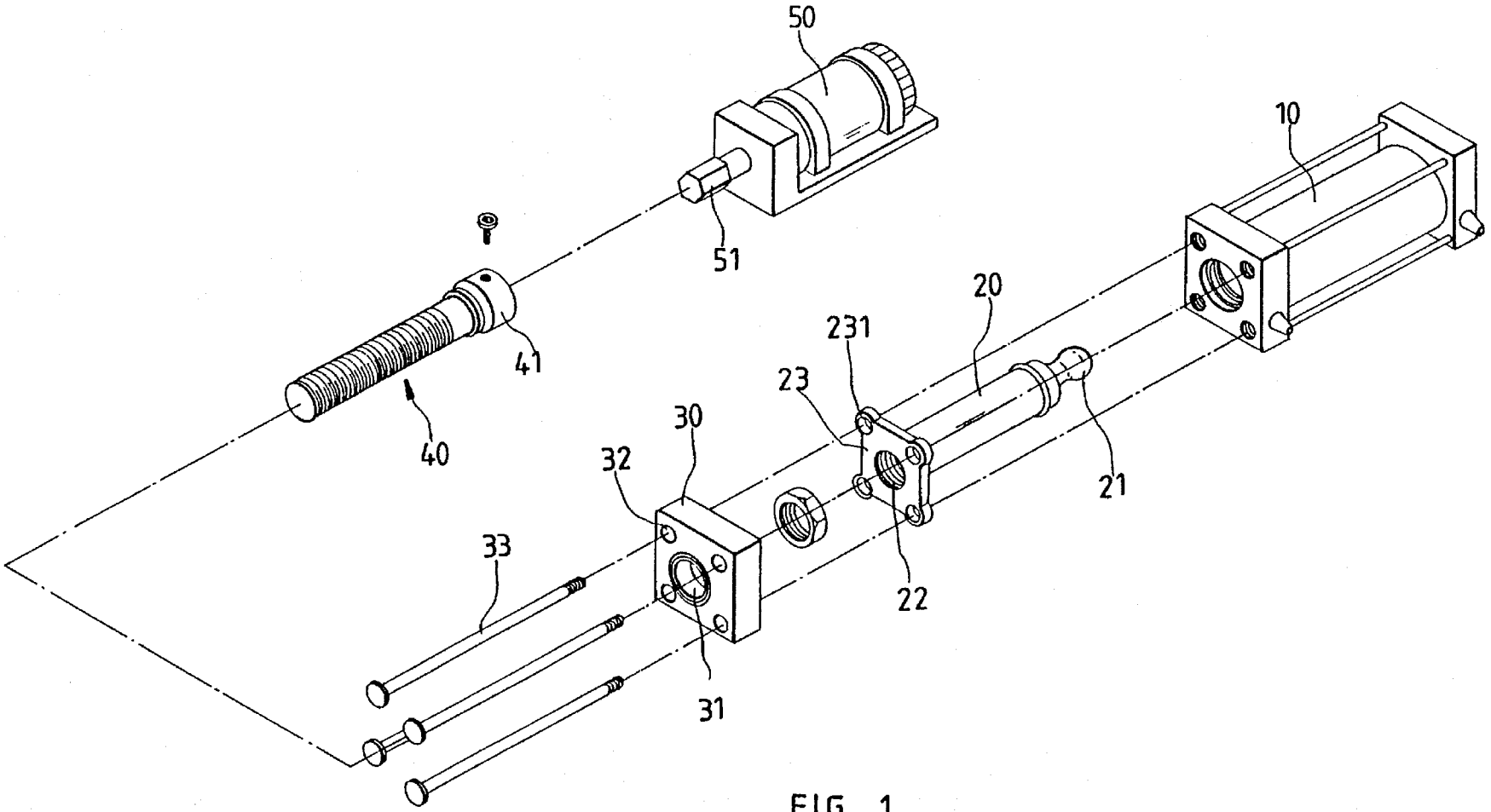
FIG. 1 shows an exploded view of a first preferred embodiment of the present invention.
Figure 2:
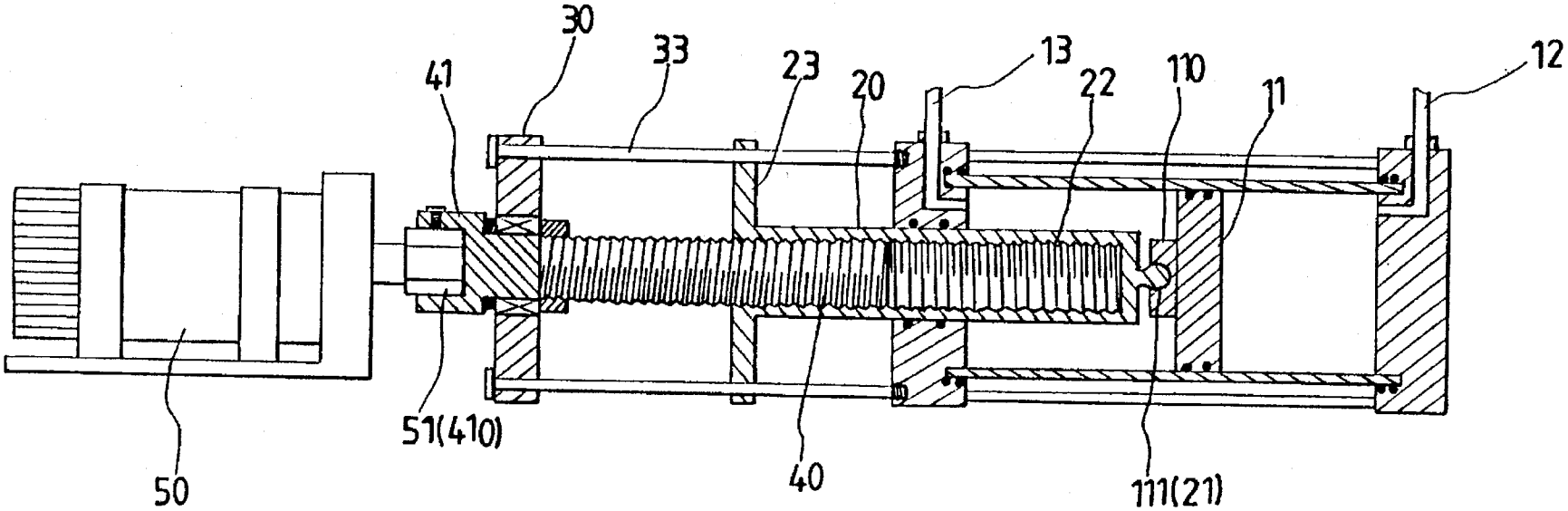
FIG. 2 shows a sectional view of the first preferred embodiment in combination according to the present invention.

As shown in FIGS. 1–4, a motion control mechanism of the oil pressure cylinder of the first preferred embodiment of the present invention comprises maily a sealed oil storing cylinder 10, a driving rod 20, a support seat 30, a threaded rod 40, and a reversible motor 50.

The oil storing cylinder 10 is provided therein with a piston 11 which is in turn provided at one end thereof with a coupling portion 110 having a fastening hole 111 of a spherical construction.

The driving rod 20 is provided at one end thereof with a spherical connection head 21 engageable with the fastening hole 111 of the coupling portion 110 of the piston 11. The driving rod 20 is further provided with another end which is capable of moving back and forth outside the oil storing cylinder 10 and which is provided with a rotation restricting plate 23 having a plurality of through holes 231. The driving rod 20 is provided therein axially with a threaded hole 22.

The support seat 30 has an axial hole 31 corresponding in location and dimension to the threaded hole 22 of the driving rod 20. The support seat 30 further has a plurality of fastening holes 32 corresponding in locatiion to the through holes 231 of the rotation restricting plate Each of the fastening holes 32 is dimensioned to receive therein a supporting rod 33 which is fastened at one end thereof with the oil storing cylinder 10 via the through hole 231 of the rotation restricting plate 23 of the driving rod 20.

The threaded rod 40 is engageable with the axial hole 31 of the support seat 30 and the threaded hole 22 of the driving rod 20. The threaded rod 40 is provided at the outer end thereof with a connection portion 41 having a retaining slot 410.

The reversible motor 50 is provided with a decelerating output shaft 51 engageable at the free end thereof with the retaining slot 410 of the threaded rod 40. As a result, the threaded rod 40 can be actuated reversibly. The supporting rods 33 serve to restrict the rotation of the driving rod 20. The piston 11 is actuated by the driving rod 20 to move back and forth within the cylinder 10.

Figure 3:
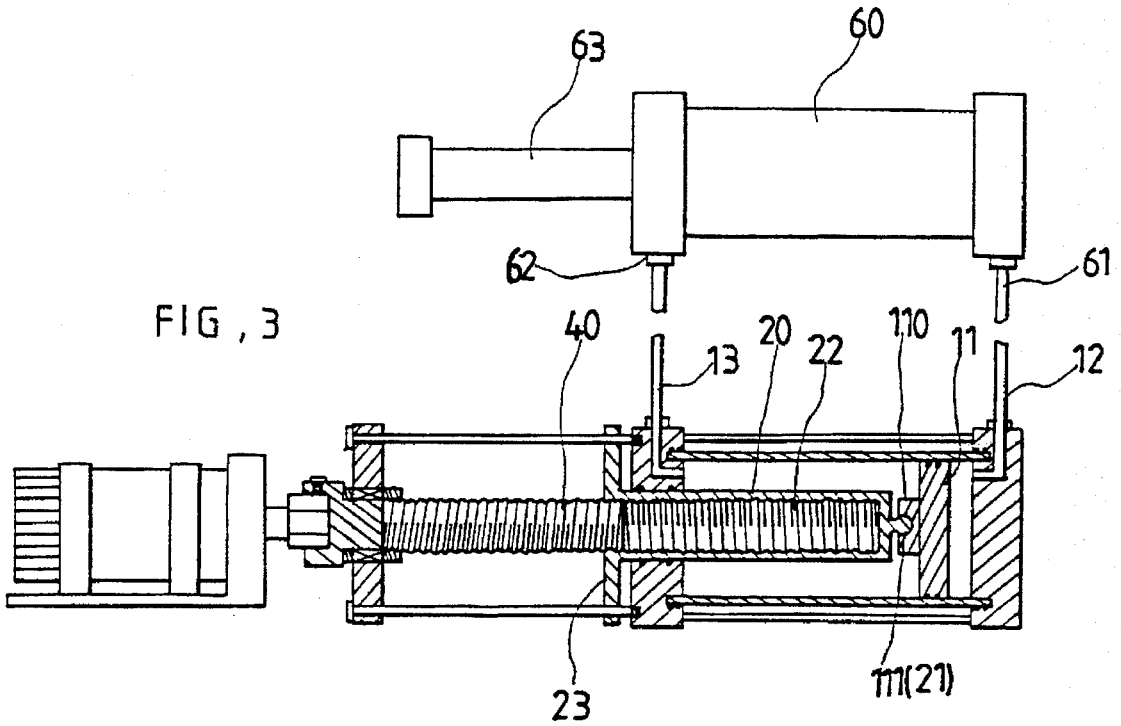
FIG. 3 is a schematic view illustrating the working of the control of the forward motion of the oil pressure cylinder of the present invention.
Figure 4:
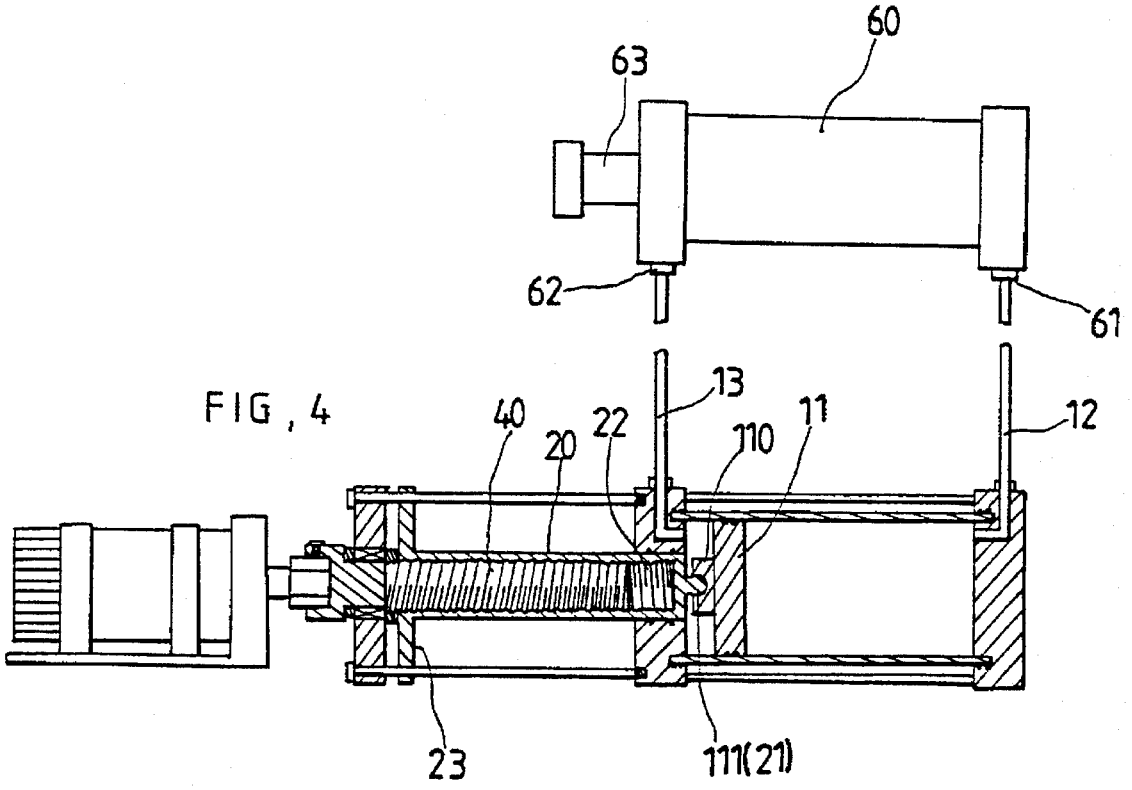
FIG. 4 is a schematic view illustrating the working of the control of the backward motion of the oil pressure cylinder of the present invention.

As illustrated in FIGS. 3 and 4, the oil storing cylinder 10 is provided respectively at both ends thereof with one oil port 12 and another oil port 13, which are engageable respectively with one oil duct 61 and another oil duct 62 of an oil pressure cylinder 60. The back-and-forth motion of a piston rod 63 of the oil pressure cylinder 60 is regulated by the back-and-forth motion of the piston 11 within the oil storing cylinder 10. In other words, the back-and-forth motion of the piston 11 within the oil storing cylinder 10. In other words, the back-and-forth motion of the piston rod 63 of the oil pressure cylinder can be controlled by the reversible motor 50.

Figure 5:
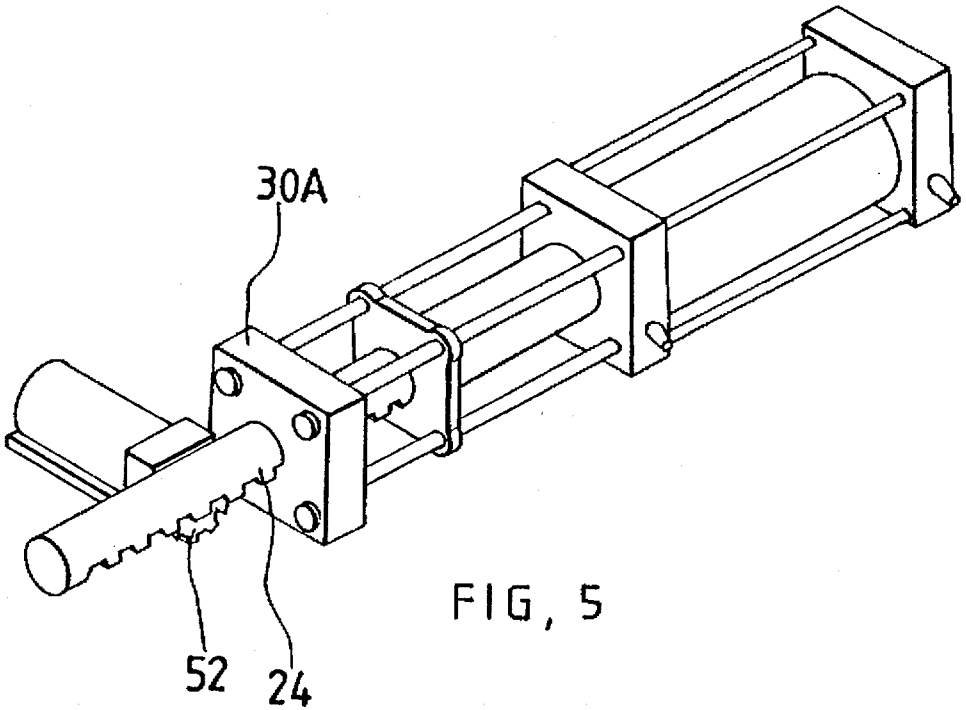
FIG. 5 shows a schematic view of a second preferred embodiment of the present invention.
Figure 5A:
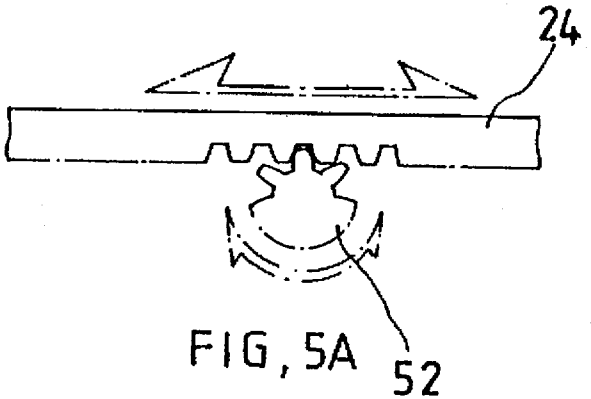

As shown in FIG. 5, the driving rod 20 of the second preferred embodiment of the present invention is provided with a toothed rod 24 which is supported by a support seat 30A and is engageable with a gear 52 fastened with the output shaft of the reversible motor 50. In other words, the power transmission is attained by the engagement of the gear 52 with the toothed rod 24 for controlling the back-and-forth motion of the driving rod 20 so as to actuate the oil pressure cylinder 60, which is not under a heavy load.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A motion control mechanism of an oil pressure cylinder comprising:

an oil storing cylinder provided therein with a piston which is in turn provided at one end thereof with a coupling portion having a fastening hole, said oil storing cylinder is further provided with two ports for allowing said oil storing cylinder to communicate with an oil pressure cylinder having a piston rod;

a driving rod provided at one end thereof with a connection portion engageable with said fastening hole of said coupling portion of said piston, said driving rod further provided therein axially with a threaded hole;

a support seat having an axial hole corresponding in dimension and location to said threaded hole of said driving rod, said support seat further having a plurality of fastening holes;

a threaded rod engageable with said axial hole of said support seat and said threaded hole of said driving rod, said threaded rod is provided at one end thereof with a connecting portion having a retaining slot; and a reversible motor provided with an output shaft engageable at a free end thereof with said retaining slot of said threaded rod for actuating said threaded rod to engage in a back-and-forth motion which serves to actuate said driving rod to engage in a back-and-forth motion outside said oil storing cylinder, said back-and-forth motion of said driving rod serving to actuate said piston to engage in a back-and-forth motion within said oil storing cylinder so as to control a back-and-forth motion of said piston rod of said oil pressure cylinder; wherein said driving rod is provided at another end thereof with a rotation restricting plate having a plurality of through holes corresponding in location and number to said fastening holes of said support seat, with said through holes of said rotation restricting plate being dimensioned to receive therein respectively a supporting rod which is fastened at one end thereof to said oil storing cylinder via one of said fastening holes of said support seat for restricting rotation of said driving rod and for supporting thereon said support seat and said rotation restricting plate of said driving rod.

* * * * *